US005352561A

United States Patent [19]

Bailey et al.

[11] Patent Number: 5,352,561

[45] Date of Patent: * Oct. 4, 1994

[54] THERMAL SOLVENTS FOR HEAT IMAGE SEPARATION PROCESSES

[75] Inventors: David S. Bailey; Ronald H. White; John Texter, all of Rochester, N.Y.

[73] Assignee: Eastman Kodak Company, Rochester, N.Y.

[ * ] Notice: The portion of the term of this patent subsequent to Dec. 14, 2010 has been disclaimed.

[21] Appl. No.: 49,048

[22] Filed: Apr. 16, 1993

Related U.S. Application Data

[62] Division of Ser. No. 804,868, Dec. 6, 1991.

[51] Int. Cl.[5] ..... G03C 5/54

[52] U.S. Cl. ..... 430/203; 430/351; 430/617; 430/619; 430/955

[58] Field of Search ..... 430/203, 351, 617, 619, 430/955

[56] References Cited

U.S. PATENT DOCUMENTS

T867,007 10/1969 Baxendale et al. .
2,835,579 5/1958 Thirtle et al. .

(List continued on next page.)

FOREIGN PATENT DOCUMENTS 0119615 9/1984 European Pat. Off. .
276319 8/1988 European Pat. Off. .
62-25754 2/1987 Japan .
62-136645 6/1987 Japan .
6014241 1/1988 Japan .
4-73751 3/1992 Japan .

*Primary Examiner*—Richard L. Schilling
*Attorney, Agent, or Firm*—Paul A. Leipold

[57] ABSTRACT

A process is disclosed for forming an improved dye image in an aqueous-developable photographic dry dye-diffusion transfer element comprising the steps of:

providing an aqueous-developable chromogenie photographic dry dye-diffusion transfer element comprising radiation sensitive silver halide, an aqueous-developable material containing color coupler wherein said coupler forms or releases a heat-transferable dye upon reaction of said coupler with the oxidation product of a primary amine developing agent, a hydrophilic binder, and a thermal solvent wherein said thermal solvent has the structure I (I)

wherein (a) $Z_1$, $Z_2$, $Z_3$, $Z_4$, and $Z_5$ are substituents, the Hammer sigma parameters of $Z_2$, $Z_3$, and $Z_4$ sum to give a total, $\Sigma$, of at least $-0.28$ and less than 1.53;

(b) the calculated IogP for I is greater than 3 and less than 10;

exposing said dye-diffusion transfer element to actinic radiation;

contacting said dye-diffusion transfer element with an aqueous-developing solution, wherein said aqueous-developing solution comprises a primary amine developing agent;

contacting said dye-diffusion transfer element with an aqueous stop bath;

drying said dye-diffusion transfer element;

providing a dye-receiving layer and contiguous support, where said dye-receiving layer is in physical contact with said dye-diffusion transfer element;

heating said dye-diffusion transfer element and dye-receiving layer to effect dye-diffusion transfer; and separating said dye-receiving layer and contiguous support from said dye-diffusion transfer element.

11 Claims, 1 Drawing Sheet

U.S. PATENT DOCUMENTS 3,227,550 1/1966 Whitmore et al. .
3,347,675 10/1967 Henn et al. .
3,438,776 4/1969 Yudelson .
3,457,075 7/1969 Morgan et al. .
3,649,280 3/1972 King et al. .
3,667,959 6/1972 Bojara et al. .
3,998,637 12/1976 Faul et al. .
4,168,980 9/1979 LaRossa .
4,228,235 10/1980 Okonogi et al. .
4,358,526 11/1982 Fujita et al. .
4,374,921 2/1983 Frenchik .
4,474,874 10/1984 Hirano et al. .
4,536,467 8/1985 Sakaguchi et al. .
4,551,422 11/1985 Kimura et al. .
4,555,470 11/1985 Sakaguchi et al. ..... 430/203
4,584,267 4/1986 Masukawa et al. .
4,590,154 5/1986 Hirai et al. .
4,626,494 12/1986 Waki et al. .
4,770,981 9/1988 Komamura et al. .
4,770,989 9/1988 Komamura et al. .
4,774,166 9/1988 Sakai et al. .
4,948,698 8/1990 Komamura .
4,952,479 8/1990 Aono et al. .
4,983,502 1/1991 Ohbayashi et al. .
5,017,454 5/1991 Nakamine et al. .
5,032,499 7/1991 Kohno et al. .
5,064,742 11/1991 Aono et al. .
5,064,753 11/1991 Schei et al. .
5,164,280 11/1992 Texter et al. ..... 430/202
5,169,742 12/1992 Takahashi et al. .

THERMAL SOLVENTS FOR HEAT IMAGE SEPARATION PROCESSES

This is a Divisional of application Ser. No. 804,868, filed Dec. 6, 1991, pending.

TECHNICAL FIELD

This invention relates to chromogenic photographic imaging systems that utilize silver halide based radiation sensitive layers and associated formation of image dyes. In particular, this invention relates to such systems where the resulting dye images, when the photographic elements are substantially dry, are transferred to a polymeric receiver layer, thereby separating the developed silver and dye images.

BACKGROUND ART

Thermal solvents in dry photothermographic systems

Heat processable photosensitive elements can be constructed so that after exposure, they can be processed in a substantially dry state by applying heat. It is known how to develop latent image in a photographic element not containing silver halide wherein organic silver salts are used as a source of silver for image formation and amplification. Such processes are described in U.S. Pat. Nos. 3,429,706 (Shepard et al.) and 3,442,682 (Fukawa et al.). Other dry processing thermographic systems are described in U.S. Pat. Nos. 3,152,904 (Sorenson et al.) and 3,457,075 (Morgan and Shely). A variety of compounds have been proposed as "carriers" or "thermal solvents" or "heat solvents" for such systems, whereby these additives serve as solvents for incorporated developing agents, or otherwise facilitate the resulting development or silver diffusion processes. Acid amides and carbamates have been proposed as such thermal solvents by Henn and Miller (U.S. Pat. No. 3,347,675) and by Yudelson (U.S. Pat. No. 3,438,776). Bojara and de Mauriac (U.S. Pat. No. 3,667,959) disclose the use of nonaqueous polar solvents containing thione, —$SO_2$— and —CO— groups as thermal solvents and carriers in such photographic elements. Similarly, La Rossa (U.S. Pat. No. 4,168,980) discloses the use of imidazoline-2-thiones as processing addenda in heat developable photographic materials.

Thermal solvents for use in substantially dry color photothermographic systems have been disclosed by Komamura et al. (U.S. Pat. No. 4,770,981), Komamura (U.S. Pat. No. 4,948,698), Aomo and Nakamaura (U.S. Pat. No. 4,952,479), and Ohbavashi et al. (U.S. Pat. No. 4,983,502). The terms "heat solvent" and "thermal solvent" in these disclosures refer to a non-hydrolyzable organic material which is a liquid at ambient temperature or a solid at an ambient temperature but melts together with other components at a temperature of heat treatment or below but higher than 40° C. Such solvents may also be solids at temperatures above the thermal processing temperature. Their preferred examples include compounds which can act as a solvent for the developing agent and compounds having a high dielectric constant which accelerate physical development of silver salts. Alkyl and aryl amides are disclosed as "heat solvents" by Komamura et al. (U.S. Pat. No. 4,770,981), and a variety of benzamides have been disclosed as "heat solvents" by Ohbayashi et al. (U.S. Pat. No. 4,983,502). Polyglycols, derivatives of polyethylene oxides, beeswax, monostearin, high dielectric constant compounds having an —$SO_2$— or —CO— group such as acetamide, ethylcarbamate, urea, methylsulfonamide, polar substances described in U.S. Pat. No. 3,667,959, lactone of 4-hydroxybutanoic acid, methyl anisate, and related compounds are disclosed as thermal solvents in such systems. The role of thermal solvents in these systems is not clear, but it is believed that such thermal solvents promote the diffusion of reactants at the time of thermal development. Masukawa and Koshizuka disclose (U.S. Pat. No. 4,584,267) the use of similar components (such as methyl anisate) as "heat fusers" in thermally developable light-sensitive materials.

Other heat developable thermal diffusion transfer systems

Hirai et al. (U.S. Pat. No. 4,590,154) disclose a heat developable color photographic light-sensitive material comprising silver halide, a hydrophilic binder, dye releasing compounds which release mobile dyes, and a sulfonamide compound. This system requires only heat to develop the latent image and to produce mobile dyes. However, the mobile dyes are affixed to an image receiving material, which must be wetted with water prior to being contacted with the heat developed donor element. The subsequent dye diffusion transfer to the receiver element is therefore of the conventional wet diffusion type.

Nakamine et al. (U.S. Pat. No. 5,107,454) disclose a heat developable photographic chromogenie system that also utilizes diffusion transfer of dyes to an image receiving (fixing) element. The dye diffusion transfer in actuality requires that the image receiving or fixing element be wetted with water prior to being affixed to the dye donor element. The resulting dye transfer, therefore, is a wet diffusion transfer of the conventional type, not dry thermal dye transfer.

Physical organic characterization of thermal solvents

Materials can be described by a variety of extrathermodynamic properties and parameters to relate their activity, according to some performance measure, to their structure. One of the best known of such classifications is the Hammett substituent constant, as described by L. P. Hammett in Physical Organic Chemistry (McGraw-Hill Book Company, New York, 1940) and in other organic text books, mono-graphs, and review articles. These parameters, which characterize the ability of meta and para ring-substituents to affect the electronic nature of a reaction site, were originally quantified by their effect on the $pK_a$ of benzoic acid. Subsequent work has extended and refined the original concept and data, but for the purposes of prediction and correlation, standard sets of such constants, $\sigma_{meta}$ and $\sigma_{para}$, are widely available in the chemical literature, as for example in C. Hansch et al., J. Med. Chem, 17, 1207 (1973).

Another parameter of significant utility relates to the variation in the partition coefficient of a molecule between octanol and water. This is the so-called IogP parameter, for the logarithm of the partition coefficient. The corresponding substituent or fragment parameter is the Pi parameter. These parameters are described by C. Itansch and A. Leo in Substituent Constants for Correlation Analysis in Chemistry and Biology (John Wiley & Sons, New York, 1969). Calculated logP (often termed cLogP) values are calculated by fragment additivity treatments with the aid of tables of substituent Pi values, or by use of expert programs that calculate octanol/water partition coefficients based on more sophisticated treatments of measured fragment values. An example of the latter is the widely used computer program, MedChem Software (Release 3.54, August 1991, Medicinal Chemistry Project, Pomona College, Claremont, Calif.).

The use of these parameters allows one to make quantitative predictions of the performance of a given molecule, and in the present invention, of a given thermal solvent candidate. The Hammett parameters are routinely summed, to give a net electronic effect Σ, where Σ is the sum of the respective substituent $\sigma_{meta\ and\ \sigma para}$ values. Substituent and fragment parameters are readily available, so that logP and Σ estimates may be easily made for any prospective molecule of interest.

Problems in the prior art

A major problem that remains in such wet developed systems, wherein the dye images so formed are transferred by diffusion through substantially dry gelatin, is to facilitate the ease with which such dye images may be transferred by diffusion. Another problem that exists is to facilitate such diffusion without inducing the crystallization of said dyes in the gelatin binder. Similar problems of dry dye diffusion transfer exist in color photothermographic systems that rely on dry development processes.

Much of the aforementioned prior art having to do with chromogenic image formation in diffusion transfer processes actually utilize a considerable amount of water in the diffusion process. The diffusion therefore is conventional diffusion transfer, rather than the extremely highly activated diffusion of said dyes through substantially dry gelatin. Diffusion of dyes through wet gelatin, when such dyes have sufficient solubilization, is relatively facile. Much of this same prior art, based on moderately wet diffusion transfer, utilizes imaging chemistry, (dye releasing compounds), that is much more expensive than the simple silver halide based indoaniline dye forming chemistry obtained in conventional wet development of silver halide systems.

These and other problems may be overcome by the practice of our invention.

DISCLOSURE OF INVENTION

An object of the present invention is to provide a chromogenie heat processabLe photographic material with a high density and low fog image. A further object of the present invention is to provide improved image dye diffusion transfer efficiency.

A further object of the present invention is to allow separation of the silver, silver halide, and unused chromogenie chemistry from the dye image. Another object of the present invention is to provide a chromogenie imaging system wherein much of the chemistry utilized in creating the image is recoverable and recyclable. Yet another object of the present invention is to provide an imaging system which minimizes toxic effluent and environmental contamination.

The present inventors have conducted exhaustive experimental investigations into the behavior of hundreds of fine organic chemicals, and their impact on mediating the thermal diffusion of photographic image dyes through hydrophilic binders in photographic elements. We have discovered that substituted phenols serve to advantageously improve the diffusion of image dyes through relatively dry photographic binders such as gelatin to a receiver element. This improved diffusion results in enhanced image dye densities in the receiver layer. These advantageous materials may be described by the general structure (I)

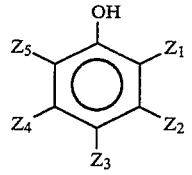

(I)

wherein $Z_1$, $Z_2$, $Z_3$, $Z_4$, and $Z_5$ are substituents, the Hammet sigma parameters of $Z_2$, $Z_3$, and $Z_4$ sum to give a total, Σ, of at least −0.28 and less than 1.53;

the calculated logP for I is greater than 3 and less than 10.

These thermal solvents are incorporated in layers in the photographic element using methods well known in the art.

DETAILED DESCRIPTION OF THE INVENTION

Compositions of the present invention yield dramatically improved dye images in receiver layers of the photographic element. This improved dye transfer efficiency enables photographic elements to be constructed using less incorporated chemistry and therefore lower manufacturing costs.

Figure 1:
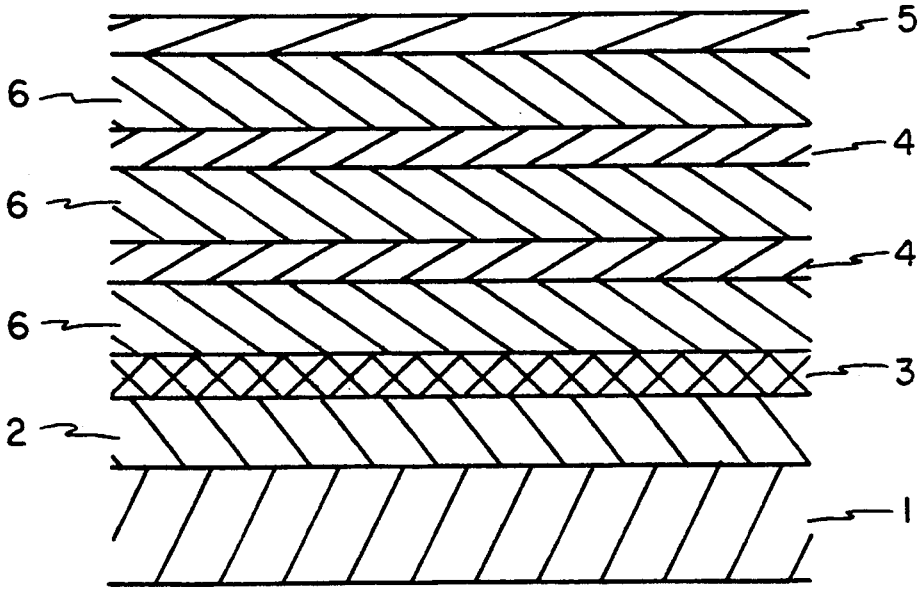
FIG. 1. Photographic element layer-structure for heat image separation system: 1—transparent or reflection base; 2—polymeric receiving layer, 3—stripping layer (optional); 4—interlayers; 5—protective overcoat layer; 6—diffusion transfer dye generation layers. The number of dye generation layers (6) is greater than or equal to one. Interlayers (4) between dye generation layers (6) are optional.

A novel method of imaging, whereby conventional wet development processes are utilized in combination with substantially dry thermally activated diffusion transfer of image dyes to a polymeric receiver has been described by Willis and Texter concurrently filed herewith now U.S. application Ser. No. 07/804,877 filed Dec. 6, 1992 and hereby incorporated by reference. The methods and processes disclosed there are incorporated herein by reference. The essential norphology of such an imaging system is illustrated in FIG. 1. It essentially consists of a conventional multilayer photographic element coated on a polymeric receiver element. The conventional element comprises one or more dye generation layers (6) and optionally one or more interlayers (4) and a protective overcoat (5) layer. This multilayer structure is coated on a receiver layer (2) with an optionally intervening stripping layer (3). The receiver layer (2) is coated on an appropriate transparent or reflection base (1). Changes are created by conventional radiation sensitivities in the silver halide emulsion containing layers, and these images are amplified using conventional aqueous color development processes.

After the development, the development is stopped with an appropriate stop bath and thereafter the element is dried. No fixing or bleaching chemistry need be invoked in this process. After the elements have been dried, they are subjected to heating, in order to drive the image dyes to the receiver layer. After such image transfer, the donor layers are removed and recycled, to recover silver and valuable fine organic compounds, and the receiver/base combination is retained as the final print material.

Texter et al. in U.S. application Ser. No. 07/805,717, now U.S. Pat. No. 5,164,280 hereby incorporated by reference, discloses a preferred method of separating receiver elements from the imaging layers. The thermal solvents of this invention are particularly effective in aiding the transfer of dyes formed by reaction of couplers with oxidized developer or by other means from imaging layers to a receiver element. The receiving element, containing the transferred dye image, is then separated from the imaging layers. Said separated receiving element constitutes the final print material.

In the present invention, thermal solvents are included in a chromogenic photographic dye-diffusion-transfer element, substantially dry and activated by heat, and comprising contacting dye-receiver and dye-donor layers. Said element comprises a layer which contains a thermal solvent according to formula (I)

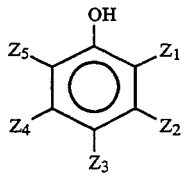

(I)

wherein $Z_1$, $Z_2$, $Z_3$, $Z_4$, and $Z_5$ are substituents, the Hammer sigma parameters of $Z_2$, $Z_3$, and $Z_4$ sum to give a total, $\Sigma$, of at least $-0.28$ and less than 1.53;

the calculated logP for I is greater than 3 and less than 10.

A list of preferred compounds is given in Tables I, II, and III.

TABLE I

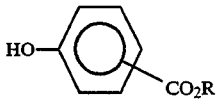

| Compound | Position (p or m) | R |
|---|---|---|
| I-1 | p | 1-hexyl |
| I-2 | p | cyclohexyl |
| I-3 | p | phenyl |
| I-4 | p | cyclopentylmethyl |
| I-5 | p | 2-hexyl |
| I-6 | p | 3-hexyl |
| I-7 | p | 2-ethyl-1-butyl |
| I-8 | p | 3,3-dimethyl-2-butyl |
| I-9 | p | 2-methyl-1-pentyl |
| I-10 | p | 2-methyl-2-pentyl |
| I-11 | p | 3-methyl-1-pentyl |
| I-12 | p | 4-methyl-2-pentyl |
| I-13 | p | 4-methyl-1-pentyl |
| I-14 | m | 1-hexyl |
| I-15 | m | cyclohexyl |
| I-16 | m | phenyl |
| I-17 | m | cyclopentylmethyl |
| I-18 | m | 2-hexyl |
| I-19 | m | 3-hexyl |
| I-20 | m | 2-ethyl-1-butyl |

TABLE I-continued

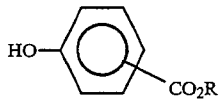

| Compound | Position (p or m) | R |
|---|---|---|
| I-21 | m | 3,3-dimethyl-2-butyl |
| I-22 | m | 2-methyl-1-pentyl |
| I-23 | m | 2-methyl-2-pentyl |
| I-24 | m | 3-methyl-1-pentyl |
| I-25 | m | 4-methyl-2-pentyl |
| I-26 | m | 4-methyl-1-pentyl |
| I-27 | p | 1-heptyl |
| I-28 | p | benzyl |
| I-29 | p | tolyl |
| I-30 | p | 2-methyl-1-phenyl |
| I-31 | p | 3-methyl-1-phenyl |
| I-32 | p | 2,2-dimethyl-3-phenyl |
| I-33 | p | 2,3-dimethyl-3-pentyl |
| I-34 | p | 3-ethyl-2-pentyl |
| I-35 | p | 3-ethyl-3-pentyl |
| I-36 | p | 2-heptyl |
| I-37 | p | 2-methyl-2-hexyl |
| I-38 | p | 3-methyl-2-hexyl |
| I-39 | p | 5-methyl-2-hexyl |
| I-40 | p | 2-methyl-5-hexyl |
| I-41 | p | cycloheptyl |
| I-42 | p | 2-methyl-1-cyclohexyl |
| I-43 | p | 3-methyl-1-cyclohexyl |
| I-44 | p | 4-methyl-1-cyclohexyl |
| I-45 | p | hexahydrobenzyl |
| I-46 | m | 1-heptyl |
| I-47 | m | benzyl |
| I-48 | m | tolyl |
| I-49 | m | 2-methyl-1-phenyl |
| I-50 | m | 3-methyl-1-phenyl |
| I-51 | m | 2,2-dimethyl-3-pentyl |
| I-52 | m | 2,3-dimethyl-3-pentyl |
| I-53 | m | 3-ethyl-2-pentyl |
| I-54 | m | 3-ethyl-3-pentyl |
| I-55 | m | 2-heptyl |
| I-56 | m | 2-methyl-2-hexyl |
| I-57 | m | 3-methyl-2-hexyl |
| I-58 | m | 5-methyl-2-hexyl |
| I-59 | m | 2-methyl-5-hexyl |
| I-60 | m | cycloheptyl |
| I-61 | m | 2-methyl-1-cyclohexyl |
| I-62 | m | 3-methyl-1-cyclohexyl |
| I-63 | m | 4-methyl-1-cyclohexyl |
| I-64 | m | hexahydrobenzyl |
| I-65 | p | 2-ethyl-1-hexyl |
| I-66 | p | 1-octyl |
| I-67 | p | 2,2-dimethyl-3-hexyl |
| I-68 | p | 2,3-dimethyl-2-hexyl |
| I-69 | p | 3-ethyl-3-hexyl |
| I-70 | p | 2,4-dimethyl-3-hexyl |
| I-71 | p | 3,4-dimethyl-2-hexyl |
| I-72 | p | 3,5-dimethyl-3-hexyl |
| I-73 | p | 2-methyl-2-heptyl |
| I-74 | p | 3-methyl-5-heptyl |
| I-75 | p | 4-methyl-4-heptyl |
| I-76 | p | 6-methyl-2-heptyl |
| I-77 | p | 2,4,4-trimethyl-2-pentyl |
| I-78 | p | cyclohexylethyl |
| I-79 | p | cycloheptylmethyl |
| I-80 | p | 3,5-dimethyl-1-cyclohexyl |
| I-81 | p | 2,6-dimethyl-1-cyclohexyl |
| I-82 | m | 2-ethyl-1-hexyl |
| I-83 | m | 1-octyl |
| I-84 | m | 2,2-dimethyl-3-hexyl |
| I-85 | m | 2,3-dimethyl-2-hexyl |
| I-86 | m | 3-ethyl-3-hexyl |
| I-87 | m | 2,4-dimethyl-3-hexyl |
| I-88 | m | 3,4-dimethyl-2-hexyl |
| I-89 | m | 3,5-dimethyl-3-hexyl |
| I-90 | m | 2-methyl-2-heptyl |
| I-91 | m | 3-methyl-5-heptyl |
| I-92 | m | 4-methyl-4-heptyl |
| I-93 | m | 6-methyl-2-heptyl |
| I-94 | m | 2,4,4-trimethyl-2-pentyl |
| I-95 | m | cyclohexylethyl |

TABLE I-continued

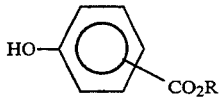

| Compound | Position (p or m) | R |
|---|---|---|
| I-96 | m | cycloheptylmethyl |
| I-97 | m | 3,5-dimethyl-1-cyclohexyl |
| I-98 | m | 2,6-dimethyl-1-cyclohexyl |
| I-99 | p | 1-nonyl |
| I-100 | p | 2-nonyl |
| I-101 | p | 3-nonyl |
| I-102 | p | 4-nonyl |
| I-103 | p | 5-nonyl |
| I-104 | p | 2-methyl-3-octyl |
| I-105 | p | 2-methyl-4-octyl |
| I-106 | p | 3-methyl-3-octyl |
| I-107 | p | 4-methyl-4-octyl |
| I-108 | p | 4-ethyl-4-heptyl |
| I-109 | p | 2,4-dimethyl-3-heptyl |
| I-110 | p | 2,6-dimethyl-4-heptyl |
| I-111 | p | 1,3-diisobutyl-2-propyl |
| I-112 | p | 2,2,3-trimethyl-3-hexyl |
| I-113 | p | 3,5,5-trimethyl-1-hexyl |
| I-114 | p | 3-cyclohexyl-1-propyl |
| I-115 | p | 1-methyl-1-cyclooctyl |
| I-116 | p | 3,3,5-trimethylcyclohexyl |
| I-117 | m | 1-nonyl |
| I-118 | m | 2-nonyl |
| I-119 | m | 3-nonyl |
| I-120 | m | 4-nonyl |
| I-121 | m | 5-nonyl |
| I-122 | m | 2-methyl-3-octyl |
| I-123 | m | 2-methyl-4-octyl |
| I-124 | m | 3-methyl-3-octyl |
| I-125 | m | 4-methyl-4-octyl |
| I-126 | m | 4-ethyl-4-heptyl |
| I-127 | m | 2,4-dimethyl-3-heptyl |
| I-128 | m | 2,6-dimethyl-4-heptyl |
| I-129 | m | 1,3-diisobutyl-2-propyl |
| I-130 | m | 2,2,3-trimethyl-3-hexyl |
| I-131 | m | 3,5,5-trimethyl-1-hexyl |
| I-132 | m | 3-cyclohexyl-1-propyl |
| I-133 | m | 1-methyl-1-cyclooctyl |
| I-134 | m | 3,3,5-trimethylcyclohexyl |
| I-135 | p | 1-decyl |
| I-136 | p | 2-decyl |
| I-137 | p | 3-decyl |
| I-138 | p | 4-decyl |
| I-139 | p | 5-decyl |
| I-140 | p | 2,2-dimethyl-3-octyl |
| I-141 | p | 4,7-dimethyl-4-octyl |
| I-142 | p | 2,5-dimethyl-5-octyl |
| I-143 | p | 3,7-dimethyl-1-octyl |
| I-144 | p | 3,7-dimethyl-3-octyl |
| I-145 | m | 1-decyl |
| I-146 | m | 2-decyl |
| I-147 | m | 3-decyl |
| I-148 | m | 4-decyl |
| I-149 | m | 5-decyl |
| I-150 | m | 2,2-dimethyl-3-octyl |
| I-151 | m | 4,7-dimethyl-4-octyl |
| I-152 | m | 2,5-dimethyl-5-octyl |
| I-153 | m | 3,7-dimethyl-1-octyl |
| I-154 | m | 3,7-dimethyl-3-octyl |
| I-155 | p | 2-methyl-4-octyl |
| I-156 | p | 3-methyl-3-octyl |
| I-157 | p | 4-methyl-4-octyl |
| I-158 | p | 4-ethyl-4-heptyl |
| I-159 | p | 2,4-dimethyl-3-heptyl |
| I-160 | p | 2,6-dimethyl-4-heptyl |
| I-161 | p | 1,3-diisobutyl-2-propyl |
| I-162 | p | 2,2,3-trimethyl-3-hexyl |
| I-163 | p | 3,5,5-trimethyl-1-hexyl |
| I-164 | p | 2-methyl-4-octyl |
| I-165 | p | 3-methyl-3-octyl |
| I-166 | p | 4-methyl-4-octyl |
| I-167 | p | 4-ethyl-4-heptyl |
| I-168 | p | 2,4-dimethyl-3-heptyl |
| I-169 | p | 2,6-dimethyl-4-heptyl |
| I-170 | p | 1,3-diisobutyl-2-propyl |

TABLE I-continued

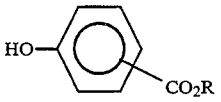

| Compound | Position (p or m) | R |
|---|---|---|
| I-171 | p | 2,2,3-trimethyl-3-hexyl |
| I-172 | p | 3,5,5-trimethyl-1-hexyl |
| I-173 | p | 1-undecyl |
| I-174 | p | 2-undecyl |
| I-175 | p | 5-undecyl |
| I-176 | p | 6-undecyl |
| I-177 | m | 1-undecyl |
| I-178 | m | 2-undecyl |
| I-179 | m | 5-undecyl |
| I-180 | m | 6-undecyl |
| I-181 | p | 1-dodecyl |
| I-182 | p | 2-dodecyl |
| I-183 | p | 2-butyl-1-octyl |
| I-184 | p | 2,6,8-trimethyl-4-nonyl |
| I-185 | p | cyclododecyl |
| I-186 | m | 1-dodecyl |
| I-187 | m | 2-dodecyl |
| I-188 | m | 2-butyl-1-octyl |
| I-189 | m | 2,6,8-trimethyl-4-nonyl |
| I-190 | m | cyclododecyl |
| I-191 | p | 1-tridecyl |
| I-192 | m | 1-tridecyl |
| I-193 | m | 2-pentyl-1-nonyl |
| I-194 | p | 1-hexadecyl |
| I-195 | p | 2-hexadecyl |
| I-196 | p | 2-hexyl-1-decyl |
| I-197 | m | 1-hexadecyl |
| I-198 | m | 2-hexadecyl |
| I-199 | m | 2-hexyl-1-decyl |

TABLE II

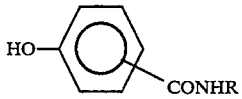

| Compound | Position (p or m) | R |
|---|---|---|
| II-1 | p | 1-hexyl |
| II-2 | p | 2-hexyl |
| II-3 | p | 1-methyl-1-pentyl |
| II-4 | p | cyclohexyl |
| II-5 | p | 1-heptyl |
| II-6 | p | 2-heptyl |
| II-7 | p | 4-heptyl |
| II-8 | p | 5-methyl-2-hexyl |
| II-9 | p | 1,4-dimethyl-1-pentyl |
| II-10 | p | cyclohexylmethyl |
| II-11 | p | 2-methyl-1-cyclohexyl |
| II-12 | p | 3-methyl-1-cyclohexyl |
| II-13 | m | 1-heptyl |
| II-14 | m | 2-heptyl |
| II-15 | m | 4-heptyl |
| II-16 | m | 5-methyl-2-hexyl |
| II-17 | m | 1,4-dimethyl-1-pentyl |
| II-18 | m | cyclohexylmethyl |
| II-19 | m | 2-methyl-1-cyclohexyl |
| II-20 | m | 3-methyl-1-cyclohexyl |
| II-21 | p | 1,1,3,3-tetramethyl-1-butyl |
| II-22 | p | 1-octyl |
| II-23 | p | 1-methyl-1-heptyl |
| II-24 | p | 2-ethyl-2-hexyl |
| II-25 | p | 2-methyl-1-heptyl |
| II-26 | p | 6-methyl-2-heptyl |
| II-27 | p | cyclooctyl |
| II-28 | p | 2-cyclohexyl-1-ethyl |
| II-29 | m | 1,1,3,3-tetramethyl-1-butyl |
| II-30 | m | 1-octyl |
| II-31 | m | 1-methyl-1-heptyl |
| II-32 | m | 2-ethyl-2-hexyl |
| II-33 | m | 2-methyl-1-heptyl |
| II-34 | m | 6-methyl-2-heptyl |

TABLE II-continued

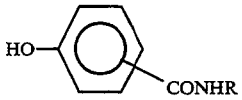

| Compound | Position (p or m) | R |
|---|---|---|
| II-35 | m | cyclooctyl |
| II-36 | m | 2-cyclohexyl-1-ethyl |
| II-37 | p | 5-nonyl |
| II-38 | p | 1-nonyl |
| II-39 | p | cyclooctylmethyl |
| II-40 | m | 5-nonyl |
| II-41 | m | 1-nonyl |
| II-42 | m | cyclooctylmethyl |
| II-43 | p | 1-decyl |
| II-44 | m | 1-decyl |
| II-45 | p | 2-undecyl |
| II-46 | p | 4-undecyl |
| II-47 | m | 2-undecyl |
| II-48 | m | 4-undecyl |
| II-49 | p | 1-dodecyl |
| II-50 | p | cyclododecyl |
| II-51 | m | 1-dodecyl |
| II-52 | m | cyclododecyl |
| II-53 | p | 2-tridecyl |
| II-54 | m | 2-tridecyl |
| II-55 | p | 1-tetradecylamine |
| II-56 | m | 1-tetradecylamine |

TABLE III

| | |
|---|---|
| III-1 | 3,4,5-trihydroxy-2'-ethyl-1'-hexyl benzoate |
| III-2 | 3,4,5-trihydroxy-1'-octyl benzoate |
| III-3 | 3,4,5-trihydroxy-2',2'-dimethyl-3'-hexyl benzoate |
| III-4 | 3,4,5-trihydroxy-1'-nonyl benzoate |
| III-5 | 3,4,5-trihydroxy-1'-decyl benzoate |
| III-6 | 1,8-octyl-bis(4'-hydroxy benzoate) |
| III-7 | 1,8-octyl-bis(3'-hydroxy benzoate) |
| III-8 | 1,10-decyl-bis(4'-hydroxy benzoate) |
| III-9 | 1,10-decyl-bis(3'-hydroxy benzoate) |
| III-10 | 3,7-dimethyl-1,7-octyl-bis(4'-hydroxy benzoate) |
| III-11 | 1,11-undecyl-bis(4'-hydroxy benzoate) |
| III-12 | 1,12-dodecyl-bis(4'-hydroxy benzoate) |
| III-13 | 1,12-dodecyl-bis(3'-hydroxy benzoate) |
| III-14 | 1,8-octyl-bis(4'-hydroxy benzamide) |
| III-15 | 1,8-octyl-bis(3'-hydroxy benzamide) |
| III-16 | 1,4-cyclohexane-bis(methyl-4'-hydroxy benzamide) |
| III-17 | 1,4-cyclohexane-bis(methyl-3'-hydroxy benzamide) |
| III-18 | 1-(methyl-4'-hydroxy benzamide)-4-(methyl-3''-hydroxy benzamide)-cyclohexane |
| III-19 | 1,9-nonyl-bis(4'-hydroxy benzamide) |
| III-20 | 1,10-decyl-bis(4'-hydroxy benzamide) |
| III-21 | 1,10-decyl-bis(3'-hydroxy benzamide) |
| III-22 | 1,12-dodecyl-bis(4'-hydroxy benzamide) |
| III-23 | 1,12-dodecyl-bis(3'-hydroxy benzamide) |
| III-24 | 3,4-dichloro-5-(1'-heptyl)phenol |
| III-25 | 3,4-dichloro-5-(1'-octyl)phenol |
| III-26 | 3,4-dichloro-5-(2'-ethyl-1'-hexyl)phenol |
| III-27 | 3,4-dichloro-5-(1'-nonyl)phenol |
| III-28 | 3,4-dichloro-5-(1'-decyl)phenol |
| III-29 | 3,4-dichloro-5-(1'-dodecyl)phenol |
| III-30 | 5-hydroxy-di-(1'-hexyl)isophthalate |
| III-31 | 5-hydroxy-di-(1'-heptyl)isophthalate |
| III-32 | 5-hydroxy-di-(1'-octyl)isophthalate |
| III-33 | 5-hydroxy-di-(2'-ethyl-1'-hexyl)isophthalate |
| III-34 | 5-hydroxy-di-(1'-nonyl)isophthalate |
| III-35 | 5-hydroxy-di-(1'-decyl)isophthalate |
| III-36 | 5-hydroxy-di-(1'-undecyl)isophthalate |
| III-37 | 5-hydroxy-di-(1'-dodecyl)isophthalate |

The coupler compound which is to be contained in the color photographic material to be used in the process of the invention may be any coupler designed to be develop-able by conventional color developer solutions, and to form a heat transferable dye upon such conventional development. While color images may be formed with coupler compounds which form dyes of essentially any hue, couplers which form heat transferable cyan, magenta, or yellow dyes upon reaction with oxidized color developing agents are used in preferred embodiments of the invention.

A typical multilayer, multicolor photographic element to be used with the thermal solvents of this invention comprises a support having thereon a red-sensitive silver halide emulsion layer having associated therewith a cyan dye image forming coupler compound, a green-sensitive silver halide emulsion layer having associated therewith a magenta dye image forming coupler compound and a blue-sensitive silver halide emulsion layer having associated therewith a yellow dye image forming coupler compound. Each silver halide emulsion layer can be composed of one or more layers and the layers can be arranged in different locations with respect to one another. Typical arrangements are described in Research Disclosure Issue Number 308, pp. 993–1015, published December, 1989 (hereafter referred to as "Research Disclosure"), the disclosure of which is incorporated by reference.

The light sensitive silver halide emulsions can include coarse, regular or fine grain silver halide crystals of any shape or mixtures thereof and can be comprised of such silver halides as silver chloride, silver bromide, silver bromoiodide, silver chlorobromide, silver chloroiodide, silver chlorobromoiodide and mixtures thereof. The emulsions can be negative working or direct positive emulsions. They can form latent images predominantly on the surface of the silver halide grains or pre-dominantly on the interior of the silver halide grains. They can be chemically or spectrally sensitized. The emulsions typically will be gelatin emulsions although other hydrophilic colloids as disclosed in Research Disclosure can be used in accordance with usual practice.

The support can be of any suitable material used with photographic elements. Typically, a flexible support is employed, such as a polymeric film or paper support:. Such supports include cellulose nitrate, cellulose acetate, polyvinyl acetal, poly(ethylene terephthalate), polycarbonate, white polyester (polyester with white pigment incorporated therein) and other resinous materials as well as glass, paper or metal. Paper supports can be acetylated or coated with polymer of an alpha-olefin containing 2 to 10 carbon atoms such as polyethylene, polypropylene or ethylene butene copolymers. The support may be any desired thickness, depending upon the desired end use of the element. In general, polymeric supports are usually from about 3 μm to about 200 μm and paper supports are generally from about 50 μm to about 1000 μm.

The dye-receiving layer to which the formed dye image is transferred according to the invention may be coated on the photographic element between the emulsion layer and support, or may be in a separate dye-receiving element which is brought into contact with the photographic element during the dye transfer step. If present in a separate receiving element, the dye receiving layer may be coated or laminated to a support such as those described for the photographic element support above, or may be self-supporting. In a preferred embodiment of the invention, the dye-receiving layer is present between the support and silver halide emulsion layer of an integral photographic element.

The dye receiving layer may comprise any material effective at receiving the heat transferable dye image. Examples of suitable receiver materials include polycarbonates, polyurethanes, polyesters, polyvinyl chlorides, poly(styrene-coacrylonitrile)s, poly(caprolactone)s and mixtures thereof. The dye receiving layer may be present in any amount which is effective for the intended purpose. In general, good results have been obtained at a concentration of from about 1 to about 10 g/m$^2$ when coated on a support. In a preferred embodiment of the invention, the dye receiving layer comprises a polycarbonate. The term "polycarbonate" as used herein means a polyester of carbonic acid and a glycol or a dihydric phenol. Examples of such glycols or dihydric phenols are p-xylylene glycol, 2,2-bis(4-oxyphenyl)propane, bis(4-oxyphenyl)methane, 1,1-bis(4-oxyphenyl)ethane, 1,1-bis(oxyphenyl)butane, 1,1-bisphenol-A polycarbonate having a number average molecular weight of at least about 25,000 is used. Examples of preferred polycarbonates include General Electric LEXAN Polycarbonate Resin and Bayer AG MACROLON 5700. Further, a thermal dye transfer overcoat polymer as described in U.S. Pat. No. 4,775,657 may also be used.

Heating times of from about 10 seconds to 30 minutes at temperatures of from about 50° to 200° C. (more preferably 75° to 160° C., and most preferably 80° to 120° C.) are preferably used to activate the thermal transfer process. This aspect makes it possible to use receiver polymers that have a relatively high glass transition temperature (Tg) (e.g., greater than 100° C.) and still effect good transfer, while minimizing back transfer of dye (diffusion of dye out of the receiver onto or into a contact material).

While essentially any heat source which provides sufficient heat to effect transfer of the developed dye image from the emulsion layer to the dye receiving layer may be used, in a preferred embodiment dye transfer is effected by running the developed photographic element with the dye receiving layer (as an integral layer in the photographic element or as part of a separate dye receiving element) through a heated roller nip. Thermal activation transport speeds of 0.1 to 50 cm/sec are preferred to effect transfer at nip pressures of from about 500 Pa to 1,000 kPa and nip temperatures of from about 75° to 190° C. The preferred amount of thermal solvent according to structure (I) incorporated in a given layer is 1 to 300% by weight of the total amount of binder present in said layer, more preferably the amount of such thermal solvent incorporated in a given layer is 20 to 150% by weight of the total amount of binder present in said layer, and most preferably the amount of such thermal solvent incorporated in a given layer is 50 to 120% by weight of the total amount of binder present in said layer.

The advantages of the present invention will become more apparent by reading the following examples. The scope of the present invention is by no means limited by these examples, however.

EXAMPLE 1-5

Compound I-65 of this invention was purchased from Pfaltz and Bauer. Comparison compounds, n-butyl phthalate, tricresyl phosphate, and N,N-diethyl dodecanamide were obtained from Kodak Laboratory Chemicals.

Thermal solvent dispersions

Colloid milled dispersions of the thermal solvents of this invention and of comparison compounds were prepared by methods well known in the art as aqueous gelatin oil-in-water emulsions, using dispersing aid DA obtained from Du Pont. On a weight basis, these aqueous dispersions were prepared as 4% thermal solvent or

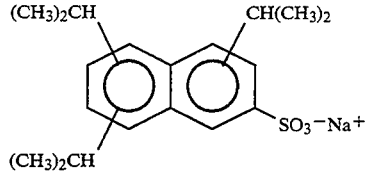

DA comparison compound and 4% gelatin, using 4 g of a 10% aqueous solution of DA. Such an aqueous suspension was passed through a colloid mill five times to obtain dispersions with submicron particle sizes. These dispersions were chill set and stored in a refrigerator until used for preparing photographic test elements.

Preparation of receiver element

A reflection base paper material, resin coated with high density polyethylene, was coated with a mixture of polycarbonate, polycaprolactone, and ST (1,4-didecyloxy-2,5-dimethoxy benzene) at a 0.77:0.115:0.115 weight ratio respectively, at a total coverage of 3.28 g/m$^2$.

Preparation of test element

A dispersion of coupler M was prepared by emulsifying 3 g of coupler M, dissolved in 15 g of refluxing ethyl acetate, with an aqueous gelatin/surfactant solution at 50° C. (23 g 12.5% (w/w) aqueous gelatin, 3.2 g 10% (w/w) DA, 65 g water). This mixture was passed five times through a colloid mill, and the product was chill set and stored in the cold until used.

Figure 2:
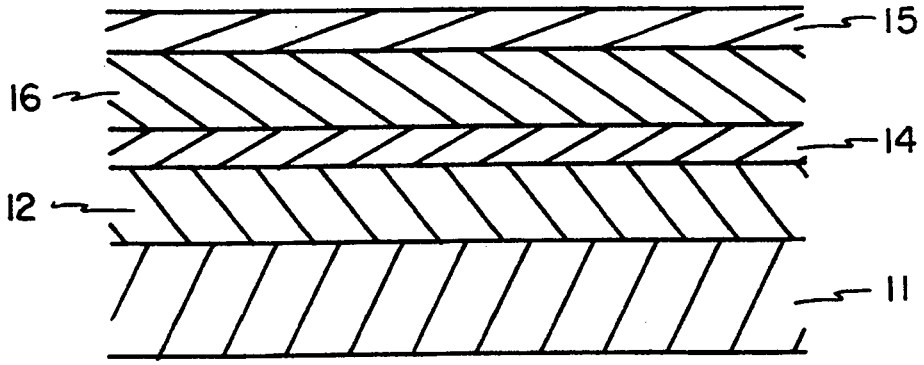
FIG. 2. Test coating format layer structure: 11—transparent or reflection base; 12—polymeric receiving layer; 14—interlayer containing gelatin and optionally thermal solvent; 15—protective overcoat layer; 16—diffusion transfer dye generation layer.

The overall layer structure for these tests is illustrated in FIG. 2. The interlayer was coated at a gelatin coverage of 1.07 g/m$^2$, and the test compounds (thermal solvents) were coated also at a coverage of 1.07 g/m$^2$ in this layer. Subsequently, a melt containing coupler (M) and green sensitized silver chloride emulsion in aqueous gelatin was coated over the test interlayer (14) to produce a light sensitive dye generating layer (16). This layer had a coverage of 1.61 g/m$^2$ of gelatin, 322 mg/m$^2$ of silver as silver chloride, and 322 mg/m$^2$ of coupler M. A protective overcoat (15) of gelatin at a coverage of 1.07 g/m$^2$ was coated over the light sensitive layer. Hardener, 1,1'-[methylene bis(sulfonyl)]bisethene, was coated at a level corresponding to 1.5% (w/w) of the total gelatin, to crosslink the gelatin.

Coupler M

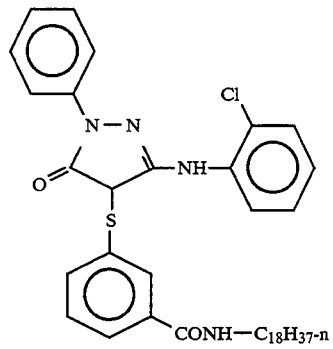

Processing and sensitometry

The coatings of these examples were exposed and processed for 45" at 95° F. in a developer solution comprising the following:

| | |
|---|---|
| Triethanolamine - | 12.41 g |
| Phorwite REU (Mobay) - | 2.3 g |
| Lithium polystyrene sulfonate (30% aqueous solution) - | 0.30 g |
| N,N-deithylhydroxylamine (85% aqueous solution) - | 5.40 g |
| Lithium sulfate - | 2.70 g |
| KODAK Color Developing Agent CD-3 - | 5.00 g |
| 1-Hydroxyethyl-1,1-diphosphonic acid (60% aqueous solution) - | 1.16 g |
| Potassium carbonate, anhydrous - | 21.16 g |
| Potassium bicarbonate - | 2.79 g |
| Potassium chloride - | 1.60 g |
| Potassium bromide - | 7.00 mg |
| Water to make one liter | |
| pH = 10.04 @ 27° C. | |

These coatings were then clipped in a stop bath, rinsed, and dried. The test coatings were then passed through pinch rollers heated to 105° C. under a nip pressure of 20 psi at a rate of 0.25 ips (inches per second). The test coatings were passed through with the photographic element coated sides in contact with the gelatin coated side of a stripping adhesion sheet, as described in U.S. Pat. No. 5,164,280. This adhesion sheet was subsequently removed by shear from the test element, thereby removing the layers 16 and 15 from the receiver/base combination (12 and 11). The resulting transferred dye scale was read by a reflection densitometry, and the corresponding $D_{max}$ are listed in Table IV. The results show that Compound I-65 of this invention has a dramatic effect on facilitating the thermal diffusion of dye through the interlayer (13) to the receiver. These results also show that the most common materials known in the art as coupler solvents are completely ineffective in promoting such dye diffusion transfer.

TABLE IV

| Example | Test Compound | $D_{max}$ |
|---|---|---|
| 1 | none (gelatin only) | 0.10 |
| 2 | di-n-butyl phthalate | 0.07 |
| 3 | tri-cresyl phosphate | 0.07 |
| 4 | N,N-diethyl lauramide | 0.07 |
| 5 | Compound I-65 (this invention) | 0.47 |

EXAMPLES 6–10

The same test format and procedures used in Examples 1 to 5 were used in preparing Examples 6 to 10, except that in the case of Example 6, no gelatin interlayer (14) was coated. Also, the pinch rollers were heated to a temperature of 110° C. in the thermal dye transfer stage of processing. Compounds I-65, I-66, I-99, and I-181 of our invention were prepared and coated as thermal solvents as described above. The corresponding dye transfer results are shown below in Table V.

TABLE V

| Example | Test Compound | $D_{max}$ |
|---|---|---|
| 6 | none (no gelatin interlayer) | 0.43 |
| 7 | Compound I-65 (this invention) | 0.78 |
| 8 | Compound I-66 (this invention) | 1.14 |
| 9 | Compound I-99 (this invention) | 1.18 |

TABLE V-continued

| Example | Test Compound | $D_{max}$ |
|---|---|---|
| 10 | Compound I-181 (this invention) | 0.65 |

These results in Table V show clearly that the compounds of this invention facilitate dye transfer through a gelatin interlayer to an extent superior to the amount of dye transfer that occurs in the absence of a blocking gelatin interlayer (Example 6).

EXAMPLES 11–13

The Compound A was presented in U.S. Pat. No. 4,948,698 as a thermal solvent. In these examples we compare the efficacy of this comparison compound as a dye transfer thermal solvent, useful in the context of the dry thermally activated diffusion transfer described herein, to Compound I-65 of our invention.

Compound A

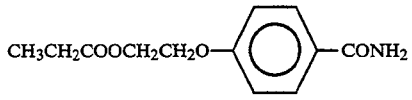

Preparation of Compound A

Methanol (365 mL) and 4-hydroxybenzamide (100 g, 0.73 tool; Aldrich) were placed in a 2-L three-necked flask set in an ice bath. To this mixture was added 29.2 g (0.73 tool) of NaOH pellets. The mixture was warmed to dissolve all of the NaOH, and then cooled to 10° C. in an ice/acetone bath. To this chilled mixture was added 91.2 g (0.73 tool) of 2-bromoethanol (Aldrich) in 140 mL methanol frown a dropping funnel while maintaining the temperature below 15° C. The reaction mixture was warmed to room temperature, and then refluxed for 3 h on a steam bath. Thin layer chromatography eluted with ethyl acetate indicated the presence of some starting material in this reaction mixture. An additional 4 g of NaOH (pellets) were added and the reaction mixture was refluxed overnight. The reaction mixture was cooled to 5°–10° C. in an ice bath for 1 h and the white solid was collected. The liquors were concentrated and chilled to obtain a second crop. The combined solids were slurried for 1 h in cold water, collected by filtration, washed with water, washed with hexane, and air dried to yield 90 g. The proton NMR was consistent with the structure of the desired intermediate, il, and the combustion analysis was satisfactory (found: C, 59.19%; H, 5.89%; N, 7.57%; calculated: C, 59.66%; H, 6.12%; N, 7.73%). The final compound A was prepared by placing triethylamine (76 g, 0.75 tool), dry ethyl acetate (450 mL), and intermediate il (42 g, 0.23 tool) in a 1-L four-neck flask, (il)

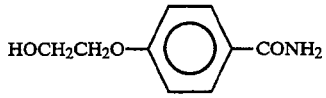

cooled in an ice bath. The mixture was cooled to 5° C. and 21.3 g (0.23 tool) of propionyl chloride in 60 mL of dry ethyl acetate was added over a 15–20 min interval from a dropping funnel slowly, keeping the temperature below 10° C. The reaction mixture was stirred at 10°–15° C. for 2 h. The reaction mixture was drowned in 2 L of ice water/HCl. More ethyl acetate was added.

The insoluble white solid formed about 15 g, was unreacted il. The layers were separated and the aqueous layer was extracted with ethyl acetate. The combined ethyl acetate layers were washed three tines with salt water, dried over $MgSO_4$, and concentrated to an oily solid (15 g). This: crude product was slurried in 100 mL hexane for 20 min, collected, and dried to leave 7 g of product. This material was recrystallized from 50 mL of toluene to yield 3 g of Compound A. Combustion analysis was satisfactory (found: C, 60.39%; H, 6.27%; N, 5.88%; calculated: C, 60.75%; H, 6.37%; N, 5.90%).

Thermal solvent dispersions

A dispersion of Compound 2 if this invention was prepared identically as described above for Example 5. A similar dispersion of Compound A was prepared, with the exception that it was prepared as an oil-in-water emulsion of an ethyl acetate solution of Compound A in aqueous gelatin/DA. After coating, the ethyl acetate was removed by evaporation.

Coating and evaluation

Coatings and evaluations were done identically as above for Examples 6 to 10. The results are illustrated in Table VI. It is apparent that the Compound I-65 of our invention works quite well, whereas the comparison Compound A has no activity whatsoever in facilitating the dry thermal diffusion of image dyes through gelatin.

TABLE VI

| Example | Test Compound | $D_{max}$ |
|---|---|---|
| 11 | none (no gelatin interlayer) | 0.43 |
| 12 | Compound A (comparison) | 0.01 |
| 13 | Compound I-65 (this invention) | 0.78 |

EXAMPLES 14–23

The same test format and procedures used in Examples 6 to 10 were used in preparing Examples 14 to 23. Compounds I-1, I-27, I-66, I-135, I-181, and II-49 of our invention were obtained from commercial sources. m-Toluamide, a "heat solvent" described in U.S. Pat. No. 4,948,698, was obtained from Kodak Laboratory. Chemicals.

Preparation of Compound I-83 m-Hydroxy benzoic acid (46 g, 0.333 mol) was placed in a 500-mL three-necked flask set in an oil bath. 1-Iodooctane (80 g, 0.33 mol), Hunig's base (43 g, 0.33 mol; N,N-diisopropyl ethyl amine), and 250 mL of dry dimethylformamide were added to the reaction mixture. The mixture was heated under nitrogen at 100° C. overnight, during which time the reaction went to completion. The mixture was drowned in 2 L of ice water, and the product was extracted out of the aqueous phase with ethyl acetate. The ethyl acetate layer was washed three times with salt water and dried over magnesium sulfate with Norit for 1 h. The ethyl acetate solution was filtered and concentrated to yield a yellow oil, compound I-83.

Preparation of Compound I-145 m-Hydroxy benzoic acid (51.5 g, 0.373 mol) was placed in a 500-mL three-necked flask set in an oil bath. 1-Iododecane (100 g, 0.373 mol), Hunig's base (48.2 g, 0.373 mol; N,N-diisopropyl ethyl amine), and 250 mL of dry dimethylformamide were added to tile reaction mixture. The mixture was heated under nitrogen at 100° C. overnight, during which time the reaction went to completion. The mixture was drowned in 2 L of ice water, and the product was extracted out of the aqueous phase with methylene chloride. The methylene chloride solution was washed twice with dilute sodium bicarbonate solution and dried over magnesium sulfate. This solution was concentrated to a dark oil, which was then chromatographed on a silica gel column, and eluted with ethyl acetate/ligroin 950 (30%/70%). The desired product, compound I-145, was obtained as a yellow oil after concentration. Upon standing, this oil crystallized to a solid to give a material melting in the range of 43°–44° C.

These compounds were dispersed and coated as thermal solvents as described in Examples 6 to 10. The corresponding dye transfer results are shown below in Table-VII. The comparison compound, m-toluamide, is essentially ineffective in facilitating dye transfer through the test gelatin interlayer. The compounds of this invention, on the other hand, provide such facilitated dye diffusion, and as illustrated in Table VII, most of these examples provide greater transfer through the test interlayer (14) than is obtained in the absence of an interlayer (Example 14).

TABLE VII

| Example | Test Compound | $D_{max}$ |
|---|---|---|
| 14 | none (no gelatin interlayer) | 0.39 |
| 15 | m-Toluamide (comparison) | 0.08 |
| 16 | Compound I-1 (this invention) | 0.26 |
| 17 | Compound I-27 (this invention) | 0.40 |
| 18 | Compound I-66 (this invention) | 1.16 |
| 19 | Compound I-83 (this invention) | 0.88 |
| 20 | Compound I-135 (this invention) | 1.21 |
| 21 | Compound I-145 (this invention) | 0.94 |
| 22 | Compound I-181 (this invention) | 0.38 |
| 23 | Compound II-49 (this invention) | 0.84 |

The invention has been described in detail with particular reference to preferred embodiments thereof, but it will be understood that variations and modifications can be effected within the spirit and scope of the invention.

What is claimed is:

1. A process for forming an improved dye image in an aqueous-developable photographic dry dye-diffusion transfer element comprising the steps of:

providing an aqueous-developable chromogenic photographic dry dye-diffusion transfer element comprising radiation sensitive silver halide, an aqueous-developable material containing color coupler wherein said coupler forms or releases a heat-transferable dye upon reaction of said coupler with the oxidation product of a primary amine developing agent, a hydrophilic binder, and a thermal solvent wherein said thermal solvent has the structure I

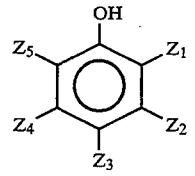

(I)

wherein (a) $Z_1$, $Z_2$, $Z_3$, $Z_4$, and $Z_5$ are substituents, the Hammet sigma parameters of $Z_2$, $Z_3$, and $Z_4$ sum to give a total, Σ, of at least −0.28 and less than 1.53;

(b) the calculated logP for I is greater than 3 and less than 10;

exposing said dye-diffusion transfer element to actinic radiation;

contacting said dye-diffusion transfer element with an aqueous-developing solution, wherein said aqueous-developing solution comprises a primary amine developing agent;

contacting said dye-diffusion transfer element with an aqueous stop bath;

drying said dye-diffusion transfer element;

providing a dye-receiving layer and contiguous support, where said dye-receiving layer is in physical contact with said dye-diffusion transfer element;

heating said dye-diffusion transfer element and dye-receiving layer to effect dye-diffusion transfer; and separating said dye-receiving layer and contiguous support from said dye-diffusion transfer element.

2. The process of claim 1, wherein the total of said hydrophilic binder amounts to from 3 to 20 g/m$^2$ of said dye-diffusion transfer element.

3. The process of claim 1, wherein said hydrophilic binder is gelatin.

4. The process of claim 1, wherein the amount of said thermal solvent incorporated in a given layer is 1 to 300% by weight of the total amount of hydrophilic binder present in said layer.

5. The process of claim 1, wherein the amount of said thermal solvent incorporated in a given layer is 50 to 120% by weight of the total amount of hydrophilic binder present in said layer.

6. The process of claim 1, wherein said thermal solvent comprises 3-hydroxy benzoic acid esters.

7. The process of claim 1, wherein said thermal solvent comprises 4-hydroxy benzoic acid esters.

8. The process of claim 1, wherein said thermal solvent comprises 3-hydroxy benzamides or 4-hydroxy benzamides.

9. The process of claim 1, wherein the sum of the Hammer sigma parameters $Z_2$, $Z_3$, and $Z_4$, Σ, is in the range 0.35 to 0.90.

10. The process of claim 1, wherein the calculated logP for I is greater than 4.5 and less than 8.

11. A process for forming an improved dye image in an aqueous-developable photographic dry dye-diffusion transfer element comprising the steps of:

providing an aqueous-developable chromogenie photographic dry dye-diffusion transfer element comprising radiation sensitive silver halide, an aqueous-developable material containing color coupler wherein said coupler forms or releases a heat-transferable dye upon reaction of said coupler with the oxidation product of a primary amine developing agent, a hydrophilic binder, and a thermal solvent wherein said thermal solvent has the structure I

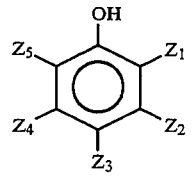

(I)

wherein (a) $Z_1$, $Z_2$, $Z_3$, $Z_4$, and $Z_5$ are substituents, the Hammet sigma parameters of $Z_2$, $Z_3$, and $Z_4$ sum to give a total, Σ, of at least −0.28 and less than 1.53;

(b) the calculated logP for I is greater than 3 and less than 10;

(c) said thermal solvent is selected from the group consisting of 3-hydroxy benzoic acid esters and 4-hydroxybenzoic acid esters;

exposing said dye-diffusion transfer element to actinic radiation;

contacting said dye-diffusion transfer element with an aqueous-developing solution, wherein said aqueous-developing solution comprises a primary amine developing agent;

contacting said dye-diffusion transfer element with an aqueous stop bath;

drying said dye-diffusion transfer element;

providing a dye-receiving layer and contiguous support, where said dye-receiving layer is in physical contact with said dye-diffusion transfer element;

heating said dye-diffusion transfer element and dye-receiving layer to effect dye-diffusion transfer; and separating said dye-receiving layer and contiguous support from said dye-diffusion transfer element.

* * * * *